United States Patent [19]

Hiramatsu et al.

[11] Patent Number: 4,598,375

[45] Date of Patent: Jul. 1, 1986

[54] TIME MEASURING CIRCUIT

[75] Inventors: Tadao Hiramatsu; Sunao Katayama, both of Aichi, Japan

[73] Assignee: Hagiwara Denki Kabushiki Kaisha, Nagoya, Japan

[21] Appl. No.: 487,918

[22] Filed: Apr. 22, 1983

[51] Int. Cl.[4] ..... G04F 10/00

[52] U.S. Cl. ..... 364/569; 377/20

[58] Field of Search ..... 328/129.1, 130.1; 364/569; 377/19, 20

[56] References Cited

U.S. PATENT DOCUMENTS

| | | | |
|---|---|---|---|
| 3,918,294 | 11/1975 | Makino et al. | 73/581 |
| 3,918,296 | 11/1975 | Kitada | 73/627 |
| 4,079,315 | 3/1978 | Mohr | 377/20 X |
| 4,267,436 | 5/1981 | Hayashi | 377/20 |
| 4,303,983 | 12/1981 | Chaborski | 377/20 X |

*Primary Examiner*—Errol A. Krass
*Assistant Examiner*—Edward R. Cosimano
*Attorney, Agent, or Firm*—Berman, Aisenberg & Platt

[57] ABSTRACT

A time measuring circuit for meters of the pulse reflection type includes a gate signal generator for producing a gate pulse signal the duration of which is proportional to a value of an object to be measured, an oscillator for producing clock pulses at a predetermined frequency, a complementary-output element responsive to the gate pulse signal for producing first and second clock pulses which are the same at their phase and relatively inverted, a pair of gates for passing therethrough the first and second clock pulses during appearance of the gate pulse signal, a flip-flop for applying the first clock pulses to a counter and for applying the first and second clock pulses to a pair of integration circuits. The counter counts the first clock pulses to produce an output signal indicative of the counted value, and the integration circuits selectively integrate the first and second clock pulses in response to the gate pulse signal. An analog-to-digital converter is connected to the integration circuits to convert the finally integrated value into a digital value, and a computer is arranged to calculate a sum of the counted value and the digital value.

6 Claims, 5 Drawing Figures

TIME MEASURING CIRCUIT

BACKGROUND OF THE INVENTION

The present invention relates to a time measuring circuit for meters of the pulse reflection type such as an ultrasonic axial force meter, an ultrasonic thickness meter or the like.

For accurate measurement of a distance by using light, an axial force of a bolt or a thickness of an object by using ultrasonic waves, it is required to measure the distance, axial force or thickness with a resolution or resolving power of approximately 1 nS. To effect such accurate measurement, an expensive high speed counter has been utilized heretofore, resulting in provision of a special and complicated circuits for the counter.

SUMMARY OF THE INVENTION

It is, therefore, a primary object of the present invention to provide an improved time measuring circuit which is capable of effecting accurate measurement of the distance, axial force or thickness with a resolution or resolving power of substantially 1 nS without provision of a high speed counter.

According to the present invention there is provided a time measuring circuit for meters of the pulse reflection type which includes a pulse oscillator means for applying a transmission pulse signal to an object to be measured, a receiving amplifier for receiving an echo pulse signal reflected from the object, a gate signal generator connected to receive the transmission pulse signal from the oscillator means and the echo pulse signal from the amplifier so as to produce a gate pulse signal the duration of which is proportional to a value of the object to be measured, first means for producing first and second output pulses at a predetermined frequency during appearance of the gate pulse signal, second means for measuring a value of the first output pulses from the first means and for producing an output signal indicative of the measured value, third means responsive to the first and second output pulses from the first means for converting the duration of the gate pulse signal into the corresponding voltage value, fourth means for converting the finally converted voltage value into a digital value and for producing an output signal indicative of the digital value, and a measuring means for measuring a sum of the measured value and the digital value in response to the output signals from the second and fourth means.

In the actual practices of the present invention, it is preferable that the first means comprises an oscillator for producing clock pulses at a predetermined frequency, a complementary-output element responsive to the gate pulse signal from the gate signal generator for producing first and second clock pulses which are the same at their phase and relatively inverted, gate means responsive to the gate pulse signal from the gate signal generator for passing therethrough the first and second clock pulses during appearance of the gate pulse signal, and a flip-flop for applying the first clock pulses to the second means and for applying the first and second clock pulses to the third means.

It is also preferable that the second means is in the form of a counter connected to the flip-flop to count the first clock pulses, the third means is in the form of a pair of integration circuits connected to the flip-flop to selectively integrate the first and second clock pulses in response to the gate pulse signal, and the fourth means is in the form of an analog-to-digital converter connected to the integration circuits to convert the finally integrated value into a digital value.

BRIEF DESCRIPTION OF THE DRAWINGS

Additional objects and advantages of the present invention will be readily apparent from the following detailed description of preferred embodiments thereof when taken together with the accompanying drawings in which.

DETAILED DESCRIPTION OF THE PREFERRED EMBODIMENTS

Figure 1:
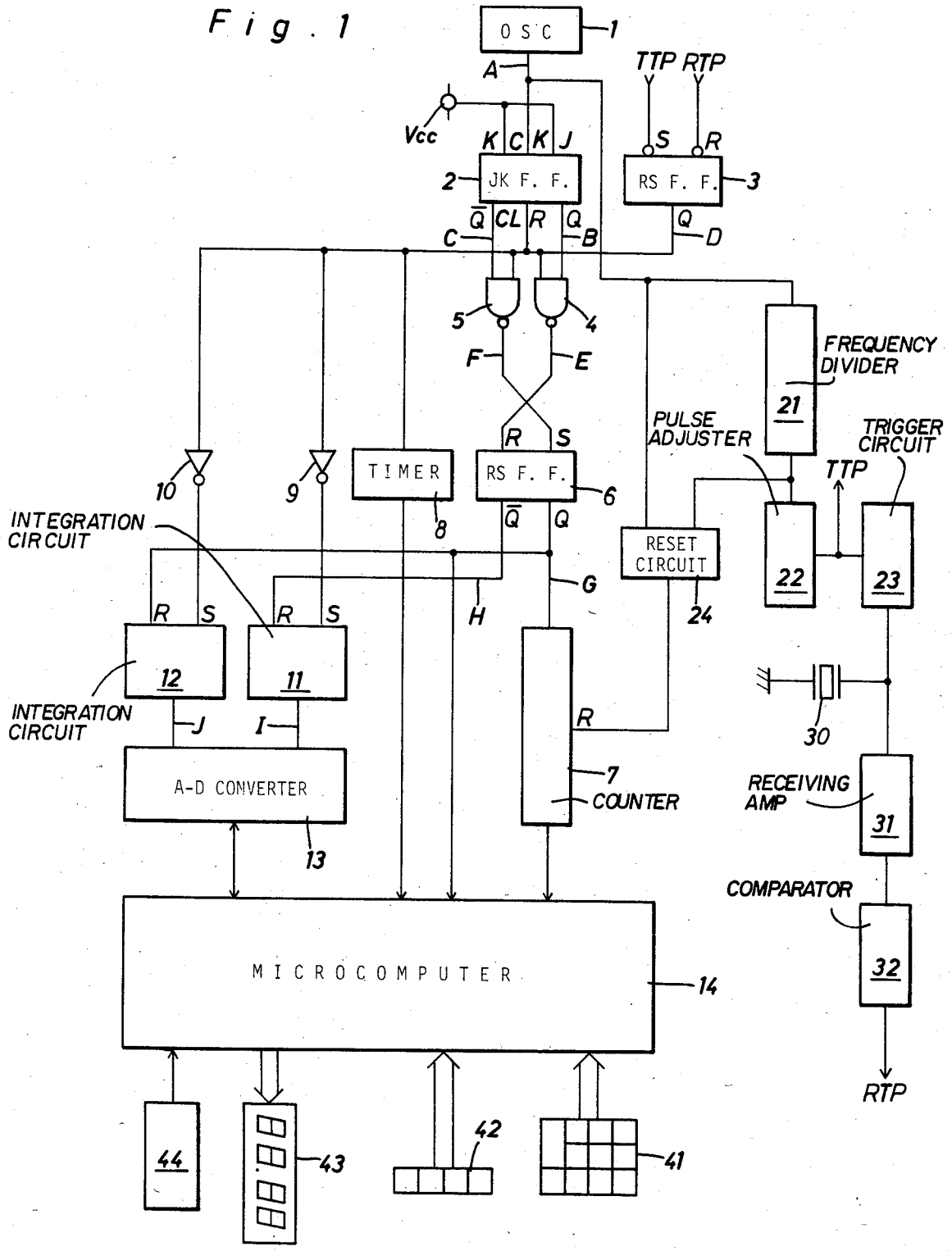
FIG. 1 is a schematic block diagram of a time measuring circuit in accordance with the present invention.

Referring now to the drawings, FIG. 1 illustrates a time measuring circuit adapted to an ultrasonic axial force meter of the pulse reflection type. The time measuring circuit includes a crystal oscillator 1 for producing clock pulses A in the form of rectangular waves at a frequency of 100 KHz–10 MHz, and a JK flip-flop 2 connected at its clock terminal CK to the output terminal of oscillator 1 and at its other input terminals J and K to a DC voltage source Vcc. The time measuring circuit further includes an RS flip-flop 3 which is applied at its set terminal S with a transmission pulse signal TTP from the ultrasonic axial force meter and at its reset terminal R with a reflection echo pulse RTP from the axial force meter. RS flip-flop 3 is connected at its output terminal Q to a clear input terminal CLR of flip-flop 2, each first input terminal of NAND gates 4 and 5, and the input terminal of a timer 8. The output terminal Q of RS flip-flop 3 is further connected to each set terminal S of first and second integration circuits 11 and 12 respectively through inverters 9 and 10. NAND gates 4 and 5 are connected at their second input terminals to output terminals Q and $\overline{Q}$ of JK flip-flop 2 and at their output terminals to reset and set terminals R and S of a second flip-flop 6 respectively.

A first output terminal Q of RS flip-flop 6 is connected to the input terminal of a counter 7, a microcomputer 14 and a reset terminal R of the second integration circuit 12, while a second output terminal $\overline{Q}$ of RS flip-flop 6 is connected to a reset terminal R of the first integration circuit 11. Each output terminal of integration circuits 11 and 12 is connected to an analog-to-digital (or A-D) converter 13 which is in turn connected to microcomputer 14. The microcomputer 14 is commercially available, the interface of which is connected at its input terminals to respective output terminals of counter 7, timer 8 and A-D converter 13.

The ultrasonic axial force meter includes a frequency divider 21 in the form of a counter for dividing the frequency of the clock pulses A from oscillator 1, and a pulse width adjustor 22 in the form of a one-shot circuit or a differentiation circuit for forming rectangular impulse waves from the divided clock pulses. The rectangular impulse waves are transmitted to a trigger circuit 23 and also transmitted as the transmission pulse signal TTP to RS flip-flop 3. The ultrasonic axial force meter further includes a probe 30 connected to trigger circuit 23 for producing an ultrasonic pulse wave, which is transmitted to an object to be measured, a receiving amplifier 31 for receiving an echo pulse train output from probe 30, and a comparator 32 for comparing an output of the amplifier 31 with a predetermined value to produce the reflection echo pulse RTP. Furthermore, the ultrasonic axial force meter includes a reset circuit 24 connected to a reset terminal R of counter 7 and responsive to the divided clock pulses from frequency divider 21 for producing a reset signal in accordance with the clock pulses from oscillator 1, a ten-key board 41 for applying an input signal indicative of a constant of the object such as a bolt to the computer 14, a select-key board 42 for selecting input data for the computer 14, an indicator 43 for indicating a value measured by the computer 14, and a thermometer 44 for measuring a temperature of the object and the ambient temperature.

Figure 2:
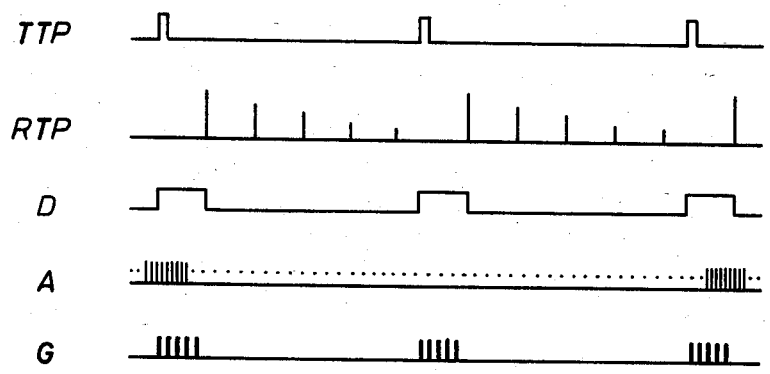
FIGS. 2, 3*a* and 3*b* illustrate waveforms appearing at various points in the circuit diagram of FIG. 1.

In operation, as is illustrated in FIG. 2, RS flip-flop 3 is set in response to the transmission pulse signal TTP to produce a gate signal D at a high level and is reset in response to the reflection echo pulse RTP to make the gate signal low level. The duration of gate signal D is proportional, for instance, to an axial length of the bolt to be measured. When received the gate signal D, causes JK flip-flop 2 to divide clock pulses A from oscillator 1 to produce at its terminals Q and $\overline{Q}$ output signals B, C in the form of rectangular waves which are relatively inverted at half the frequency of the clock pulses. When the level of gate signal D becomes low, the output signal B from terminal Q is maintained at a high level, while the output signal C from terminal $\overline{Q}$ is maintained at a low level. NAND gates 4 and 5 are responsive to the gate signal D to permit the output signals B and C applied to the second RS flip-flop 6 from JK flip-flop 2. When the level of gate signal D becomes low, the timer 8 produces a high level signal therefrom after lapse of a time t, and the computer 14 is responsive to the high level signal from timer 8 to receive output signals from counter 7 and A-D converter 13, as is described in detail later.

Figure 3:
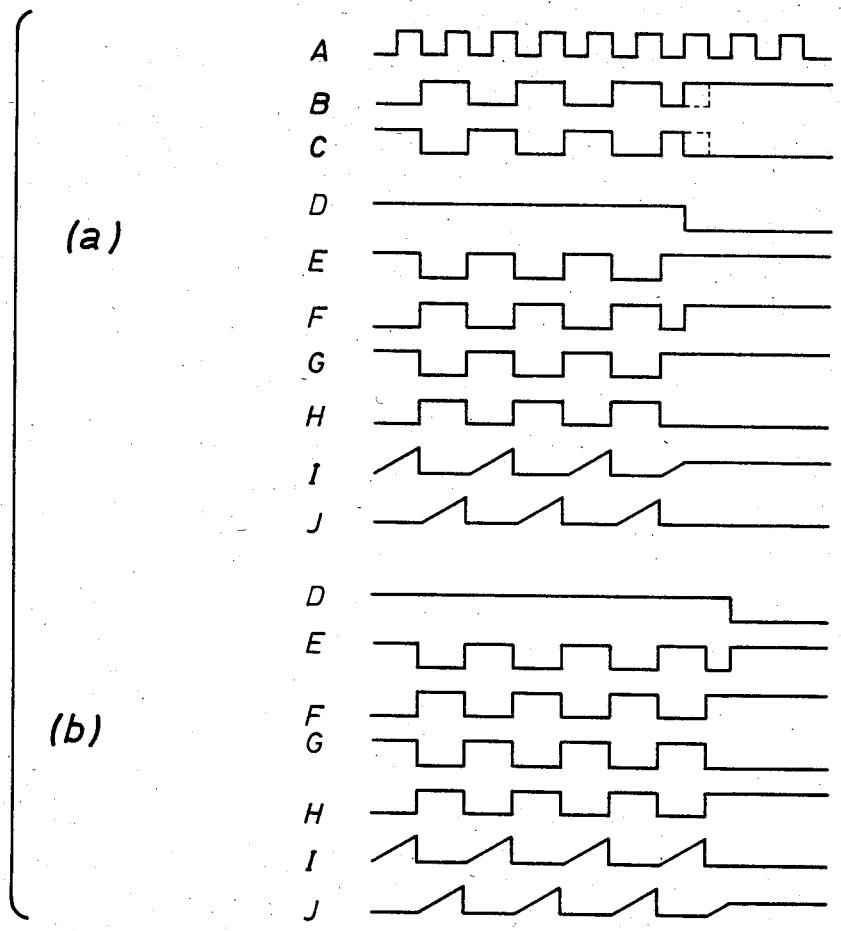

As is illustrated in FIG. 3, the output signals B and C from JK flip-flop 2 are relatively inverted into the output signals E and F from NAND gates 4 and 5 during appearance of the gate signal D. When the level of gate signal D becomes low, the output signals E and F are maintained at a high level respectively. When, the second RS flip-flop 6 receives at its terminals R and S relatively inverted output signals E and F during appearance of the gate signal D, it produces relatively inverted output signals G and H at its terminals Q and $\overline{Q}$. Upon disappearance of the gate signal D, the second RS flip-flop 6 acts to memorize each level of the output signals E and F.

If the level of gate signal D becomes low when the output signals B and C from JK flip-flop 2 are at low and high levels respectively, the output signal G from RS flip-flop 6 is applied as an input signal with a high level to the counter 7, as is illustrated in (a) of FIG. 3. If the level of gate signal D becomes low when the output signals B and C from JK flip-flop 2 are at high and low levels respectively, the output signal G from RS flip-flop 6 is applied as an input signal with a low level to the counter 7, as is illustrated in (b) of FIG. 3. As a result, the counter 7 acts to count the number of the output signals G from RS flip-flop 6 thereby to measure a time $T_1$. Furthermore, the computer 14 discriminates the operation of integration circuit 11 or 12 in relation to the level of the output signal G from RS flip-flop 6 to produce an output signal therefrom for activation of A-D converter 13.

When applied with the output signal H with the low level from RS flip-flop 6, the first integration circuit 11 operates to produce an output signal I in the form of saw tooth waves. In this instance, A-D converter 13 is responsive to the output signal from computer 14 to convert the final voltage level of output signal I into a digital value indicative of a time $T_2$. In the case that the full scale of each saw tooth wave of signal I represents a time defined by one-fourth the frequency of the clock pulses, the time $T_2$ is measured by a digital value converted from the final saw tooth wave of signal I. This means that resolution or resolving power in measurement of the time $T_2$ can be easily enhanced up to, for instance, 1 ns in dependence upon the capacity of A-D converter 13 related to the frequency of the clock pulses. When applied with the output signal G with the low level from RS flip-flop 6, as is illustrated in (b) of FIG. 3, the second integration circuit 12 operates to produce an output signal J in the form of saw tooth waves. In this instance, A-D converter 13 is responsive to the output signal from computer 14 to convert the final voltage level of output signal J into a digital value indicative of a time $T_3$. This means that resolution or resolving power in measurement of the time $T_3$ can be easily enhanced up to, for instance, 1 ns in dependence upon the capacity of A-D converter 13 related ot the frequency of the clock pulses.

In such operation as described above, integration circuits 11 and 12 start to integrate the low levels of input signals H and G applied to their reset terminals R respectively during appearance of the gate signal D and discharge when each level of the input signals H and G becomes high. When the level of gate signal D becomes low, the integration circuits 11 and 12 act to hold therein the finally integrated voltages respectively, and subsequently A-D converter 13 is activated in response to the output signal from computer 14 in relation to the level of the output signal G to convert the integrated voltage into the digital value and produces an output signal indicative of the digital value upon completion of the voltage conversion. When applied with the output signal from A-D converter 13, the computer 14 receives an output signal from counter 7 to measure a sum of the time $T_1$ and the time $T_2$ or $T_3$, and the counter 7 is reset by a reset signal from reset circuit 24.

In the case that the microcomputer 14 is applied with the input signal G with the high level upon disappearance of the gate signal D, it measures the time T on a basis of the following equation:

$$T=T_1+T_2$$

In the case that the microcomputer 14 is applied with the input signal G with the low level upon disappearance of the gate signal D, it measures the time T on a basis of the following equation:

$$T=T_1+T_2+T_3$$

where the value of $T_2$ is determined in its full scale.

Figure 4:
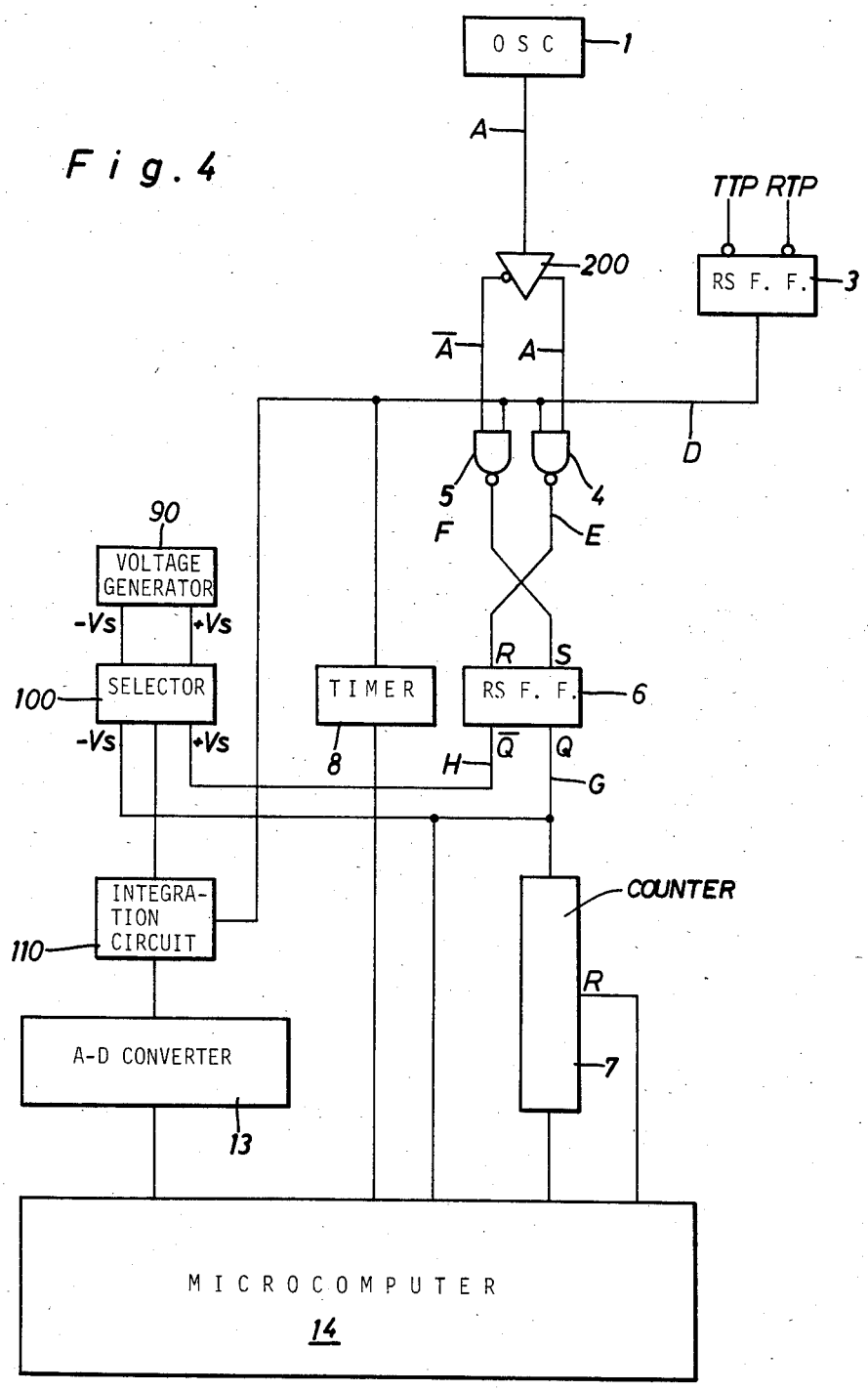
FIG. 4 is a schematic block diagram of a modification of the time measuring circuit of FIG. 1.
Figure 5:
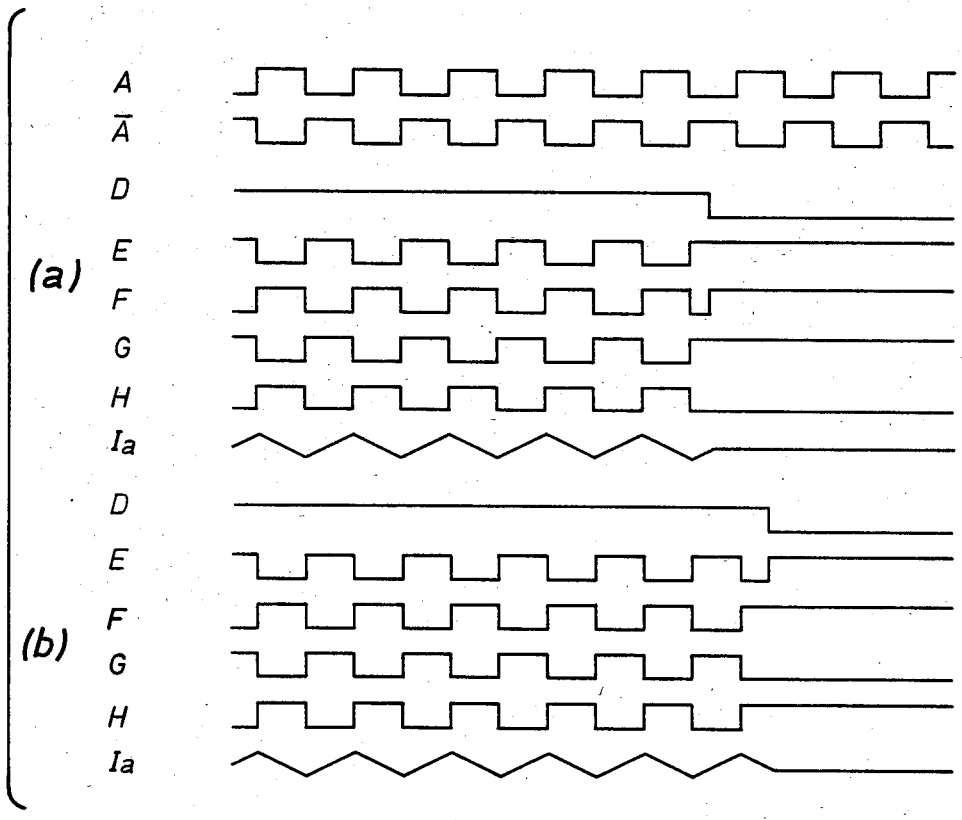
FIGS. 5*a* and 5*b* illustrates waveforms appearing at various points in the circuit diagram of FIG. 4.

In FIG. 4 there is illustrated a modification of the time measuring circuit described above, in which JK flip-flop 2 in FIG. 1 is replaced with a complementary-output element 200, and the integration circuits 11 and 12 are replaced with a voltage generator 90, a selector 100 and a single integration circuit 110. The complementary-output element 200 is arranged to produce relatively inverted clock pulses A and $\overline{A}$ at the same phase in response to input clock pulses from oscillator 1. The voltage generator 90 is arranged to produce positive and negative voltage signals $+V_{s'}-V_s$ which are the same at their voltage levels and different at their polarity, the selector 100 is, for example, in the form of an analog switch which is connected to voltage generator 90 to produce a positive voltage signal $+V_s$ in response to the high level signal H from RS flip-flop 6 and to produce a negative voltage signal $-V_s$ in response to the high level signal G from RS flip-flop 6, and the integration circuit 110 is arranged to charge in response to the positive voltage signal $+V_s$ and discharge in response to the negative voltage signal $-V_s$ thereby to produce an output signal $I_a$ in the form of triangular waves as is illustrated in FIG. 5. The other arrangements are substantially the same as those in the time measuring circuit of FIG. 1.

Having thus described the preferred embodiments of the invention it should be understood that numerous structural modifications and adaptations may be resorted to without departing from the spirit of the invention. For instance, it is noted that A-D converter 13 of the above embodiment may be replaced with a voltage-frequency converter with a counter.

What is claimed is:

1. A time measuring circuit for meters of the pulse reflection type including a pulse oscillator means for applying a transmission pulse signal to an object to be measured, a receiving amplifier for receiving an echo pulse signal reflected from said object, a gate signal generator connected to said oscillator means and said amplifier to receive the transmission pulse signal and the echo pulse signal so as to produce a gate pulse signal the duration of which is proportional to a time interval between the pulse signals to be measured, and measuring means for measuring the duration of the gate pulse signal;

wherein the improvement comprises:

first means for producing first and second output pulses at a predetermined frequency during appearance of the gate pulse signal;

second means for counting the first output pulses from said first means and for producing an output signal indicative of the counted value;

third means responsive to the first and second output pulses from said first means for converting the duration of the gate pulse signal into the corresponding voltage value; and fourth means for converting the finally converted voltage value into the corresponding digital value and for producing an output signal indicative of the digital value; and wherein said measuring means is arranged to measure a sum of the counted value and the digital value in response to the output signals from said second and fourth means.

2. A time measuring circuit as claimed in claim 1, wherein said first means comprises:

an oscillator for producing clock pulses at a predetermined frequency;

a complementary-output element responsive to the gate pulse signal from said gate signal generator for producing first and second clock pulses which are the same at their phase and relatively inverted;

gate means responsive to the gate pulse signal from said gate signal generator for passing therethrough the first and second clock pulses during appearance of the gate pulse signal; and a flip-flop for applying the first clock pulses to said second means and for applying the first and second clock pulses to said third means.

3. A time measuring circuit as claimed in claim 2, wherein said complementary-output element is the form of a JK flip-flop connected to said oscillator to receive the clock pulses and responsive to the gate pulse signal from said gate signal generator to produce first and second clock pulses which are the same at their phase and relatively inverted, and said gate means includes a pair of NAND gates connected to said JK flip-flop to apply the first and second clock pulses to said first-named flip-flop in response to the gate pulse signal from said gate signal generator.

4. A time measuring circuit as claimed in claim 2, wherein said third means includes a voltage generator for generating positive and negative voltage signals which are the same at their voltage levels and different at their polarity, a selector means connected to said voltage generator for producing a positive voltage signal in response to the first clock pulses from said flip-flop and producing a negative voltage signal in response to the second clock pulses from said flip-flop, and an integration circuit connected to said selector means to charge in response to the positive voltage signal from said selector means and discharge in response to the negative voltage signal from said selector means.

5. A time measuring circuit as claimed in claim 2, wherein said second means is in the form of a counter connected to said flip-flop to count the first clock pulses, said third means is in the form of a pair of integration circuits connected to said flip-flop to selectively integrate the first and second clock pulses in response to the gate pulse signal from said gate signal generator, and said fourth means is in the form of an analog-to-digital converter connected to said integration circuits to convert the finally integrated value into a digital value.

6. A time measuring circuit as claimed in claim 5, wherein said measuring means is in the form of a microcomputer arranged to calculate a sum of the counted value of the first clock pulses and the digital value from said analog-to-digital converter.

* * * * *